US011130035B2

(12) United States Patent
Chen et al.

(10) Patent No.: US 11,130,035 B2
(45) Date of Patent: Sep. 28, 2021

(54) ARTIFICIAL SHUTTLECOCK

(71) Applicant: Victor Rackets Industrial Corp., Taipei (TW)

(72) Inventors: Shu-Jung Chen, Taipei (TW); Tzu-Wei Wang, Taipei (TW); Hsin-Chen Wang, Taipei (TW)

(73) Assignee: Victor Rackets Industrial Corp., Taipei (TW)

( * ) Notice: Subject to any disclaimer, the term of this patent is extended or adjusted under 35 U.S.C. 154(b) by 0 days.

(21) Appl. No.: 17/002,909

(22) Filed: Aug. 26, 2020

(65) Prior Publication Data

US 2021/0060400 A1 Mar. 4, 2021

(30) Foreign Application Priority Data

Aug. 28, 2019 (TW) ..... 108130917

(51) Int. Cl.
*A63B 67/18* (2016.01)
*A63B 67/19* (2016.01)

(52) U.S. Cl.
CPC ..... *A63B 67/19* (2016.01)

(58) Field of Classification Search
CPC ..... A63B 67/187; A63B 67/19
See application file for complete search history.

(56) References Cited

U.S. PATENT DOCUMENTS

| | | | | |
|---|---|---|---|---|
| 2,757,932 A * | 8/1956 | Shaw | A63H 5/00 473/571 |
| 3,089,704 A * | 5/1963 | Wolf | A63B 67/187 473/579 |
| 9,440,130 B2 * | 9/2016 | Dai | A63B 67/187 |
| 10,065,096 B2 * | 9/2018 | Chen | A63B 67/187 |
| 2014/0155201 A1 * | 6/2014 | Yoneyama | A63B 67/187 473/580 |

FOREIGN PATENT DOCUMENTS

CN 204485251 U 7/2015

* cited by examiner

*Primary Examiner* — John A Ricci
(74) *Attorney, Agent, or Firm* — Karin L. Williams; Alan D. Kamrath; Mayer & Williams PC

(57) ABSTRACT

The present Disclosure discloses an artificial shuttlecock, which includes a base portion, a plurality of stems, a plurality of feathers, a first connecting element, a second connecting element and at least one third connecting element. The base portion includes a concave portion. One end of the stem connects to the base portion, and the feather connects to the other end of the stem. The first connecting element connects to the stems, and is close to the base portion. The second connecting element connects to the stems, and is close to the feathers. The third connecting element connects to the stems, and is located between the first connecting element and the second connecting element.

19 Claims, 7 Drawing Sheets

ARTIFICIAL SHUTTLECOCK

BACKGROUND

1. Field of the Disclosure

The present disclosure relates to an artificial shuttlecock.

2. Description of Related Art

Badminton competition is a common and popular ball game, and players compete by hitting the shuttlecock. The main structure of conventional shuttlecock is that natural feather is combined to the base portion, wherein the natural feathers are mostly goose feathers or duck feathers, which are bleached and screened before being made into a shuttlecock. However, it is becoming more and more difficult to obtain natural feathers, and the screening procedures are complicated and labor-consuming Therefore, there are also artificial shuttlecocks on the market, trying to resolve the issues of shortage and complicated screening of the natural feathers.

Most of the artificial shuttlecocks use nylon to make a soft frame to replace natural feathers, and the structure of the soft frame carries the airflow generated during the hitting. However, a shuttlecock made of such a soft frame does not provide a hitting feel as good as a shuttlecock made of natural feathers, so it is hard to be accepted by users. At present, there is also a design using fiber-reinforced resin material as the stem and lightweight foam material as the feather. The appearance of this type of artificial shuttlecock is similar to that of natural shuttlecock, and the hitting feel is better than that made of soft frame. However, the strength (toughness) and durability of the stem made of fiber-reinforced resin material is not as good as the natural shuttlecock stem.

FIG. 1 is a schematic diagram of the conventional artificial shuttlecock 9. Generally speaking, artificial shuttlecock 9 comprises a base portion 91, a plurality of stems 92, a plurality of feathers 93, and two connecting elements 94. The feather 93 connects to one end of the stem 92, and the other end of the stem 92 inserts into the base portion 91. The connecting element 94 is wound around the stem 92 to make the distance between two adjacent stems 92 fix. In order to increase the durability of the stem, there is also a design to replace the stem 92 of artificial shuttlecock 9 with a carbon fiber material (for instance, patent application CN201520145603.0) to increase the strength (toughness) and durability of the stem 92. However, the stem 92 made of carbon fiber is likely to cause damage to the base portion 91 and the stem 92, thereby causing the breakage of the stem 92. For instance, when kill-shooting a ball, the stem 92 is subjected to a strong external force, resulting in stress concentration in the region A where stem 92 is inserted in the base portion 91, which easily leads to breakage of the stem 92 at the region between the base portion 91 and the closest connecting element 94, thereby reducing the overall durability of the artificial shuttlecock 9. There is indeed a need for improvement. It should be noted that for simplicity regions A and B are marked only in one stem 92 in FIG. 1.

SUMMARY

In view of the above, the main object of the present disclosure is to provide an artificial shuttlecock, which resolves the issues of reduced overall durability of the conventional artificial shuttlecock made of carbon fiber stem by a novel structural design of connecting the stem and the base portion.

To achieve the above object, the present disclosure provides an artificial shuttlecock, which comprises a base portion, a plurality of stems, a plurality of feathers, a first connecting element, a second connecting element and at least one third connecting element. The base portion has a top surface and a concave portion, and the concave portion is arranged on the top surface. The stems have a first end and a second end opposite to each other. The first ends of the stems are inserted onto the top surface of the base portion. The feather is connected to one of the hair rods and close to the second end. The first connecting element is connected to the stems and close to the base portion. The second connecting element is connected to the stems and close to the feathers. The third connecting element is connected to the stems and located between the first connecting element and the second connecting element.

According to one embodiment of the present disclosure, adjacent two stems have a spacing range, and the first connecting element, the second connecting element, and the third connecting element are connected to the stem, so that the spacing range of the adjacent two stems is fixed.

According to one embodiment of the present disclosure, the distance between the first connecting element and the base portion is between 5 mm and 14.5 mm.

According to one embodiment of the present disclosure, the distance between the second connecting element and the feather is between 0.01 mm and 5 mm.

According to one embodiment of the present disclosure, the distance between the second connecting element and the base portion is between 17.5 mm and 29 mm.

According to one embodiment of the present disclosure, the first connecting element, the second connecting element, and the third connecting element are the same kind of members.

According to one embodiment of the present disclosure, the first connecting element, the second connecting element, and the third connecting element are respectively a wire wound around the stem.

According to one embodiment of the present disclosure, the first connecting element, the second connecting element, and the third connecting element are parallel to each other.

According to one embodiment of the present disclosure, the distances of the third connecting element with the first connecting element and with the second connecting element are substantially the same.

According to one embodiment of the present disclosure, the distances of the third connecting element with the first connecting element and with the second connecting element are between 5 mm and 17.5 mm.

According to one embodiment of the present disclosure, the base portion further comprises a convex surface located on the opposite side of the top surface, and the concave portion extends from the top surface to the convex surface.

According to one embodiment of the present disclosure, the concave portion is in a symmetrical shape on the top surface.

According to one embodiment of the present disclosure, the concave portion is symmetrical in shape with reference to a center of the top surface.

According to one embodiment of the present disclosure, the concave portion and the top surface are arranged in a manner of concentric circle.

According to one embodiment of the present disclosure, the concave portion is a circular-shape or a ring-shape.

According to one embodiment of the present disclosure, the volume of the concave portion accounts for 1% to 7% of the volume of the base portion. According to one embodiment of the present disclosure, the weight of the base portion, after filling the concave portion with the same material as the base portion, is 0.06 g to 0.10 g more than the original weight of the base portion.

According to one embodiment of the present disclosure, the material of the stem is a carbon fiber-reinforced resin material.

According to one embodiment of the present disclosure, the feather comprises two holes, and the holes are respectively located on two opposite sides of the stem.

As stated above, according to the artificial shuttlecock of the present disclosure, at least three connecting elements of the first connecting element, the second connecting element, and the third connecting element are used to fix the stem to reduce its shaking. In addition, the base portion has a concave portion, capable of destroying the structure of the base portion and reducing the stress concentration between the base portion and the stem, thereby avoiding the breakage of the stem. With the aforementioned two novel structural designs, the durability of the artificial shuttlecock is greatly improved.

METHOD OF IMPLEMENTATION

In order to enable reviewers to better understand the technical content of the present disclosure, a preferred specific embodiment is described as follows.

Figure 2:
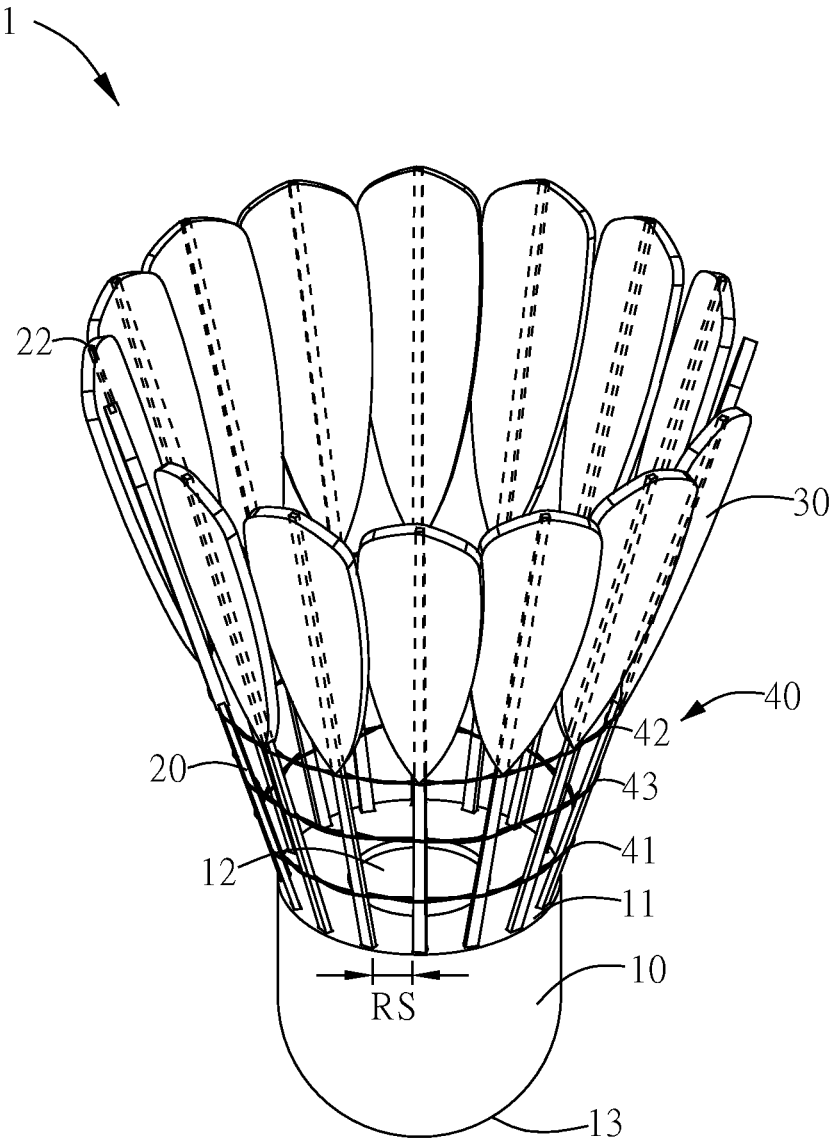
FIG. 2 is a three-dimensional schematic diagram of the artificial shuttlecock in one of the embodiments of present disclosure.
Figure 3:
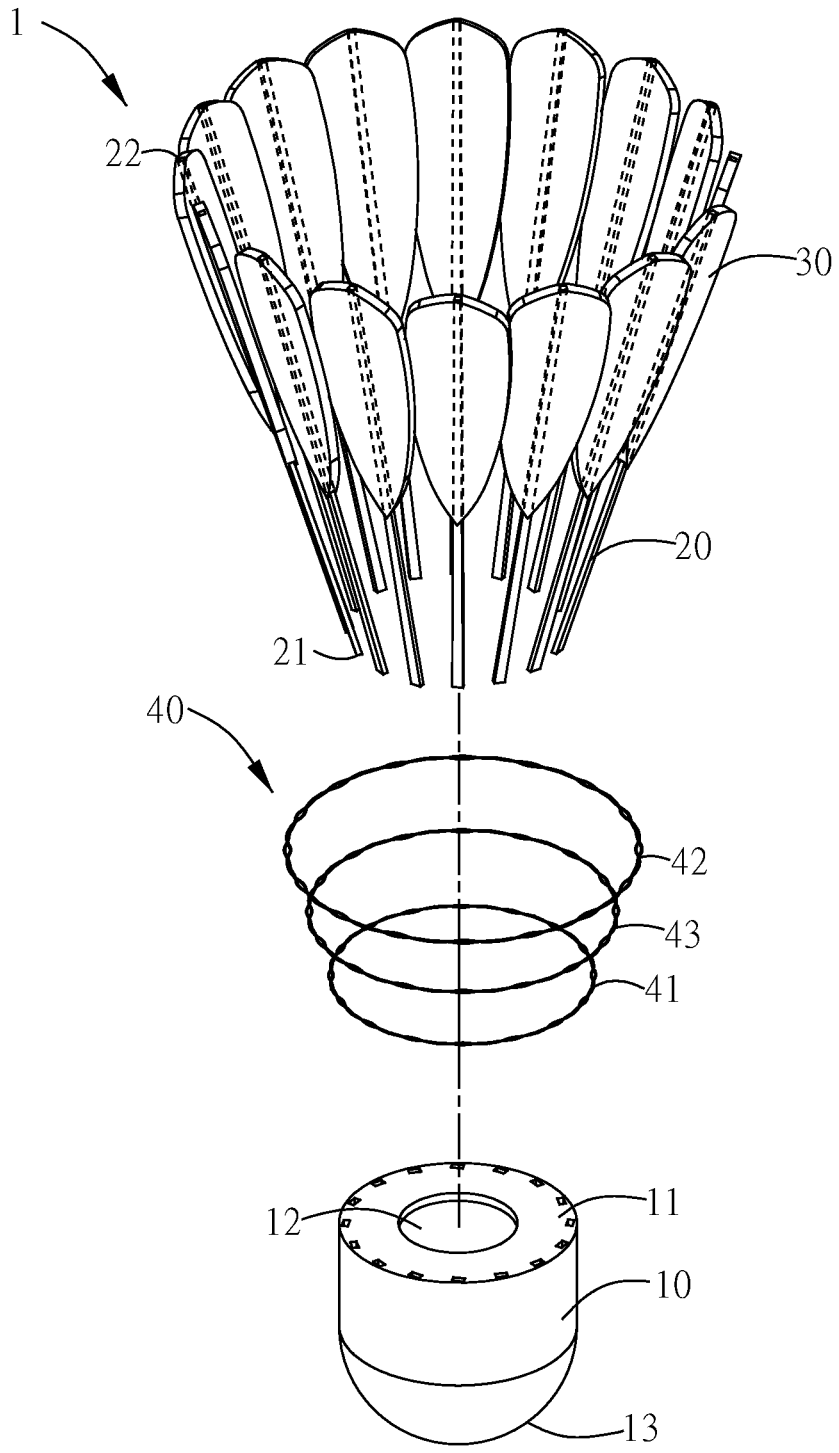
FIG. 3 is an exploded schematic diagram of the artificial shuttlecock shown in FIG. 2.
Figure 4:
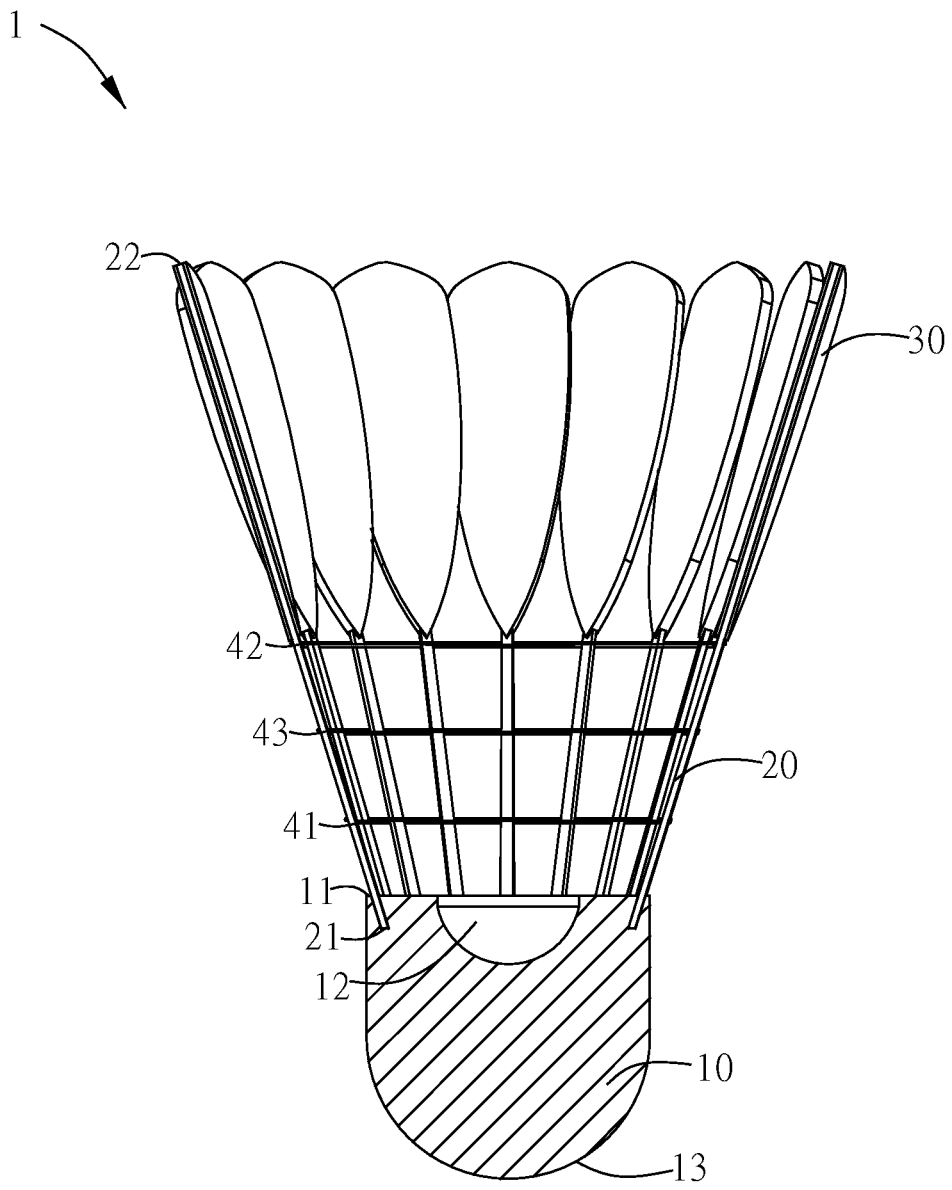
FIG. 4 is a schematic sectional view of the artificial shuttlecock shown in FIG. 2.

FIG. 2 is a three-dimensional schematic diagram of the artificial shuttlecock in one of the embodiments of present disclosure. FIG. 3 is an exploded schematic diagram of the artificial shuttlecock shown in FIG. 2. FIG. 4 is a schematic sectional view of the artificial shuttlecock shown in FIG. 2. Refers to FIG. 2, FIG. 3 and FIG. 4 The artificial shuttlecock 1 of this embodiment comprises a base portion 10, a plurality of stems 20, a plurality of feathers 30, and a connecting assembly 40, wherein the connecting assembly 40 comprises a first connecting element 41, a second connecting element 42 and at least one third connecting element 43. This embodiment takes one third connecting element 43 as an example.

The base portion 10 of this embodiment has a top surface 11, a concave portion 12 and a convex surface 13, and the convex surface 13 is located on the opposite side of the top surface 11. One side of the base portion 10 is a semi-cylindrical structure, and the convex surface 13 is the surface of the semi-cylindrical structure. The top surface 11 and the convex surface 13 are located on two opposite surfaces of the base portion 10, and the top surface 11 can be inserted by the stems 20. In addition, the concave portion 12 is arranged on the top surface 11, and the concave portion 12 extends from the top surface 11 to the convex surface 13. In other words, the concave portion 12 is a groove extending from the top surface 11 to the inside of the base portion 10, as shown in FIG. 4.

Figure 1:
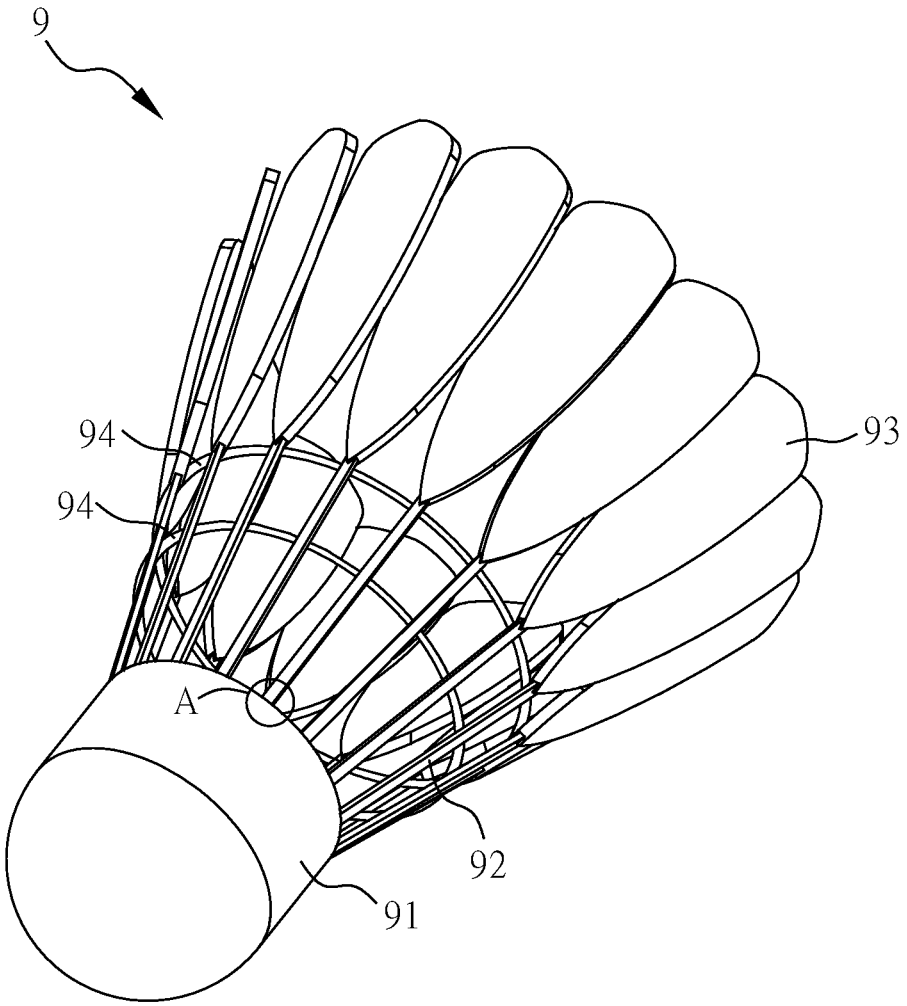
FIG. 1 is a schematic diagram of the conventional artificial shuttlecock.
Figure 5:
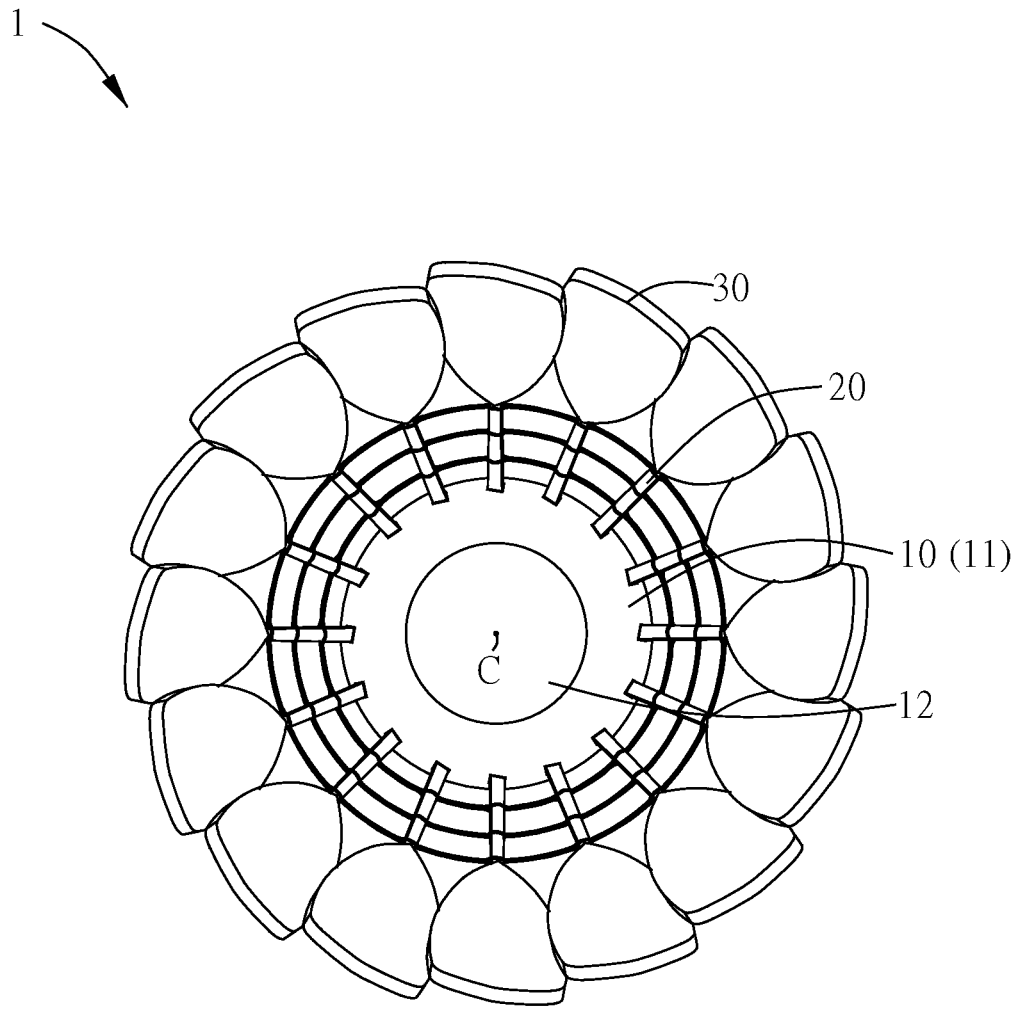
FIG. 5 is a top view of the artificial shuttlecock shown in FIG. 1.

FIG. 5 is a top view of the artificial shuttlecock shown in FIG. 1. FIG. 4 and FIG. 5 are shown for reference. In this embodiment, the concave portion 12 is in a symmetrical shape on the top surface 11, such as a circular-shape, a ring-shape, or a polygonal shape of 4 sides, 8 sides or 16 sides. Preferably, the concave portion 12 is symmetrical in shape with reference to a center C of the top surface 11, which can be, for example, but not limited to, a circle, a ring, or the aforementioned symmetrical polygons. Preferably, the concave portion 12 and the top surface 11 can be arranged in a manner of concentric circle. In this way, the concave portion 12 can be a circular-shape or a ring-shape. The concave portion 12 in this embodiment takes a circular shape as an example. In this embodiment, the volume of the concave portion 12 accounts for 1% to 7% of the volume of the base portion 10. Generally speaking, the volume of the base portion 10 is about 10,866 $mm^3$, so the volume of the concave portion 10 (the hollow portion) can be between 414 $mm^3$ and 692 $mm^3$ The volume of the base portion 10 in this embodiment is 553 $mm^3$.

In the manufacturing of the artificial shuttlecock 1, a base portion 91 without a concave portion 12 (like the base portion 91 in the prior art, so described with the same designation) can be taken first. Then, taking the circular center of the top surface of the base portion 91 as the center point, a symmetrical shape, such as a circle, is chiseled to form the base portion 10 and the concave portion 12 of the present embodiment. Specifically, draw a circle with a diameter of about 8 mm, whose center is the same as that of the top surface of the base portion 91 (as shown in FIG. 5). Next, based on the drawn circle, a groove with a depth of about 11 mm to 11.5 mm (as shown in FIG. 4) is chiseled into the base portion 91, forming a concave portion 12 with a volume of 553 $mm^3$ For the base portion 10 and its concave portion 12 of the present embodiment, if the base portion 10 (or base portion 91) is made of cork, the weight of the cork chiseled out is about 0.06 g to 0.10 g, preferably 0.08 g. In other words, the weight of the base portion 10 (that is, the weight of the base portion 91), after filling the concave portion 12 (a volume of 553 $mm^3$) with the same material as the base portion 10 (for instance, a cork), is 0.06 g to 0.10 g more than the original weight of the base portion 10, preferably 0.08 g. It should be noted that the weight chiseled out to form the concave portion 12 is related to the number of the third connecting elements 43. In this embodiment, the third connecting element 43 is taken one as an example, so the chiseled weight is between 0.06 g to 0.10 g. In other embodiments, if the number of third connecting elements 43 is increased, the chiseled weight will also increase proportionally, that is, the volume of the concave portion 12 will also increase proportionally.

Referring to FIG. 2 and FIG. 3, each stem 20 has a first end 21 and a second end 22 opposite to each other. A plurality of stems 20 are arranged at intervals on the base portion 10, and the first end 21 of the stem 20 is inserted onto the top surface 11 of the base portion 10. Moreover, the second end 22 of the stem 20 is connected to the feather 30, that is, feathers 30 are respectively connected to one of the stems 20 and close to the second end 22. In this embodiment, the material of the stem 20 is carbon fiber-reinforced resin in order to increase the durability of the stem 20. Specifically, the stem 20 of this embodiment is composed of unidirectionally (UD) stacked carbon fiber cloth and woven glass fiber cloth, which can increase the strength and durability of the stem 20.

Preferably, the feather 30 is attached to the stem 20 with glue, and is close to the second end 22 of the stem 20. In this embodiment, every two pieces of the feathers 30 are combined with one piece of stem 20, that is, two of the plural pieces of feathers 30 are attached to one of the plural pieces of stems 20. Moreover, every two pieces of feathers 30 are respectively attached to the opposite sides of the stem 20. Specifically, each one surface of the two pieces of feathers 30 is coated with glue, and the glued surface is bonded to the opposite sides of the stem 20. Finally, the other parts of the two pieces of feathers 30 are pressed together to make the two pieces of feathers 30 bond to each other. Preferably, after the feather 30 is bonded to the stem 20, the first end 21 of the stem 20 is inserted into the base portion 10.

In addition, the feather 30 of this embodiment can be an artificial feather to replace natural feather, wherein the feather 30 is made of plastic with a density between 0.9 $g/cm^3$ to 1.48 $g/cm^3$, and the plastic can be, for example but not limited to, low density polyethylene (LDPE), linear low density polyethylene (LLDPE), polyethylene terephthalate (PET), polyethylene resin (PE), polypropylene (PP), acrylonitrile-butadiene-styrene (ABS), polyamide (PA) and extruded polyethylene (EPE) and so on. Preferably, the feather 30 can be a combination of LDPE and LLDPE. In addition, the overall configuration of the feather 30 roughly corresponds to the configuration of the feathers of a natural shuttlecock. Specifically, the configuration of the feather 30 can be symmetrical with the stem 20 as the symmetrical axis, such as a kite-shaped configuration.

After the stems 20 are arranged at intervals on the base portion 10, the connecting assembly 40 is used to fix the distance between two adjacent stems 20. The connecting assembly 40 of this embodiment is composed of three connecting elements, namely the first connecting element 41, the second connecting element 42, and the third connecting element 43. In other words, the first connecting element 41, the second connecting element 42, and the third connecting element 43 are connected to the stem 20, wherein the first connecting element 41 is close to the base portion 10, the second connecting element 42 is close to the feather 30, and the third connecting element 43 is located between the first connecting element 41 and the second connecting element 42.

Specifically, adjacent two stems 20 have a spacing range SR, and the first connecting element 41, the second connecting element 42, and the third connecting element 43 are connected to the stem 20, such that the spacing range SR of the adjacent two stems is fixed. It should be noted that since the stem 20 can be inserted obliquely onto the top surface 11 of the base portion 10, the spacing between the two adjacent stems 20 is not a constant, and the closer to the second end 22, the greater the spacing. Therefore, the spacing range SR is used here instead of a fixed value. In this embodiment, the first connecting element 41, the second connecting element 42, and the third connecting element 43 can be the same kind of members. Preferably, the first connecting element 41, the second connecting element 42, and the third connecting element 43 are respectively a wire wound around the stem 20 to fix the spacing between the stems 20. Preferably, after the first connecting element 41, the second connecting element 42, and the third connecting element 43 are wound to the stem 20, glue is applied to the first connecting element 41, the second connecting element 42, the third connecting element 43, and the contacted stem 20.

Figure 6:
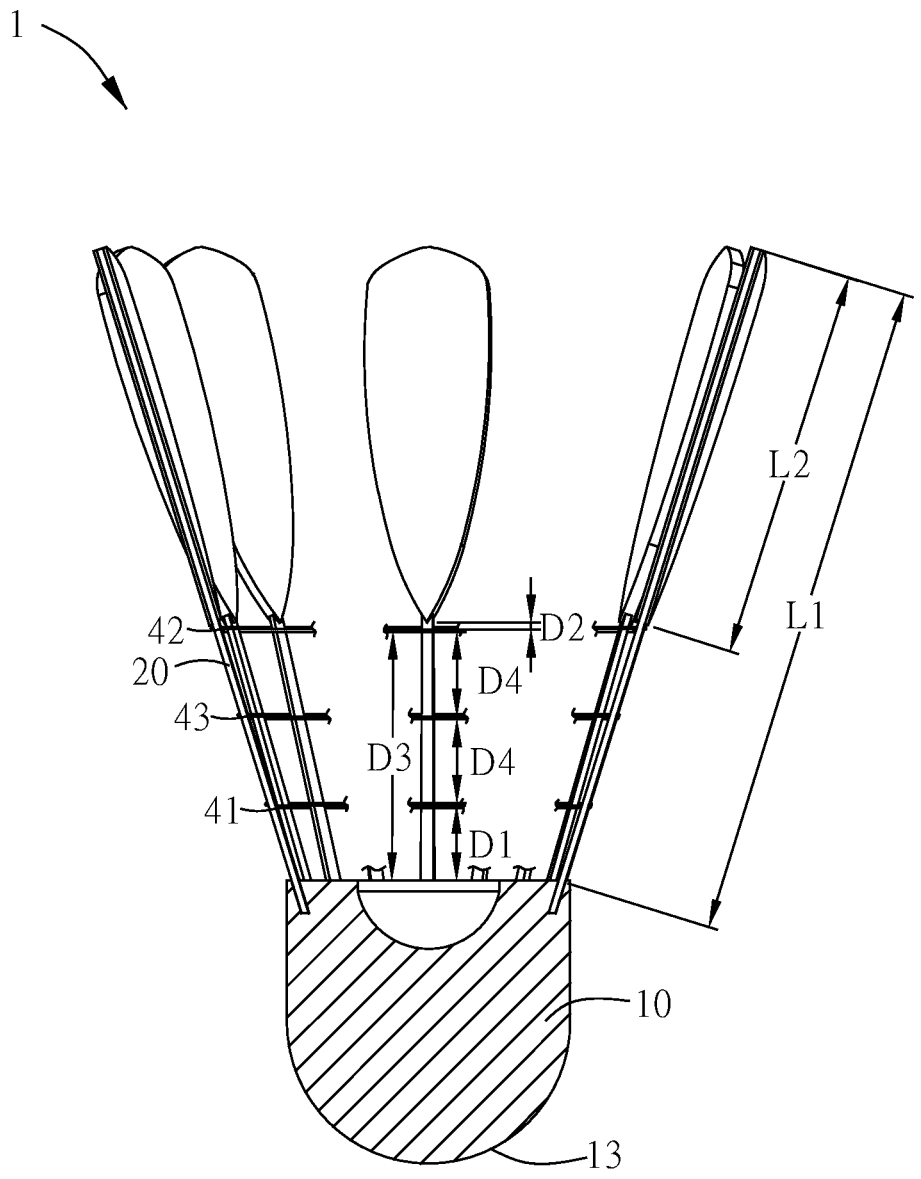
FIG. 6 is a partial schematic diagram of the artificial shuttlecock shown in FIG. 4.

In the manufacturing of the artificial shuttlecock 1, the first connecting element 41 and the second connecting element 42 can be provided first, and then the third connecting element 43 can be arranged between the first connecting element 41 and the second connecting element 42. FIG. 6 is a partial schematic diagram of the artificial shuttlecock shown in FIG. 4, with the dimension of each structure marked and some structures omitted. FIGS. 4 and 6 are shown for reference. The length L1 of the stem 20 exposed outside the base portion 10 in this embodiment can be between 61.5 mm and 66 mm, and the length L2 of the feather 30 can be between 36 mm and 39 mm. In this embodiment, the distance D1 between the first connecting element 41 and the base portion 10 can be between 5 mm and 14.5 mm, and preferably 8 mm. In addition, the distance D2 between the second connecting element 42 and the feather 30 can be between 0.01 mm and 5 mm. In other words, the second connecting element 42 can also be adjacent to the feather 93 (for instance, the distance D2 is 0.01 mm) The distance D3 between the second connecting element 42 and the base portion 10 can be between 17.5 mm and 29 mm.

When the relative positions of the first connecting element 41 and the second connecting element 42 are determined, the third connecting element 43 is arranged between the first connecting element 41 and the second connecting element 42. Preferably, the first connecting element 41, the second connecting element 42, and the third connecting element 43 are parallel to each other, so the distances D4 of the third connecting element 43 with the first connecting element 41 and with the second connecting element 42 are substantially the same, so the same distances D4 are marked in FIG. 6. In other embodiments, the distances of the third connecting element 43 with the first connecting element 41 and the second connecting element 42 can be different, and there is no particular limitation to the present disclosure. Preferably, the distances D4 of the third connecting element 43 with the first connecting element 41 and with the second connecting element 42 are between 5 mm and 17.5 mm.

Table 1 is a durability test report of artificial shuttlecock with various structures.

TABLE 1

| Designation of artificial shuttlecock | Structural characteristics | Durability | Note |
|---|---|---|---|
| A | (1) a total of two connecting elements<br>(2) no concave portion | 5 stems breakage under 7 kill shots | similar to the conventional artificial shuttlecock 9 |
| B | (1) a total of two connecting elements<br>(3) with concave portion | 2 stems breakage under 7 kill shots | |
| C | (1) a total of three connecting elements | 1 stems breakage | |

TABLE 1-continued

| Designation of artificial shuttlecock | Structural characteristics | Durability | Note |
|---|---|---|---|
| | (2) no concave portion | under 10 kill shots | |
| D | (1) a total of three connecting elements<br>(2) with concave portion<br>(3) the distances to D1 is 8 mm | no breakage under 25 kill shots | similar to the conventional artificial shuttlecock 1 of the above-mentioned embodiment |
| E | (1) a total of three connecting elements<br>(2) with concave portion<br>(3) the distances to D1 is 6 mm | no breakage under 25 kill shots | |
| F | (1) a total of three connecting elements<br>(2) with concave portion<br>(3) the distances to D1 is 14.5 mm | no breakage under 25 kill shots | |

From the durability test results shown in the above table, it can be seen that when both the condition (1) there exist three connecting elements (i.e., the first connecting element 41, the second connecting element 42 and the third connecting element 43) and the condition (2) the base portion 10 has a concave portion 12 are met, the durability is greatly improved. That is, compared with the designation A (the conventional artificial shuttlecock 9), the number of kill shots for designations D, E, and F in Table 1 is increased by more than 3 times (for instance, the original 7 kill shots is increased to 25 kill shots or more).

As shown in FIG. 1, the conventional artificial shuttlecock 9 (designation A in Table 1) has only two connecting elements 94. Therefore, when the player kill shoots the artificial shuttlecock 9, the binding force of the connecting elements 94 to the stem 92 is weak. However, the base portion 91 and the stem 92 are stronger structures, thereby causing a stress concentration of the stem 92 at the base portion 91 (like the region A in FIG. 1) and making the stem 92 easier to be broken at between the stem 92 and the nearest connecting element 94. On the other hand, if only by increasing the number of connecting elements (3 pieces) to increase the binding force of the stem, like the designation C in Table 1, the durability that can be improved is limited, and the number of kill shots that can be increased is less than twice. Because if only the concave portion is formed on the base portion to reduce the stress concentration between the base portion and the stem, like the designation B in Table 1, only a little durability is improved. For instance, under the same 7 kill shots, the number of broken stems is reduced from 5 to 2.

The artificial shuttlecock 1 (designation D in Table 1) of the present embodiment uses at least three connecting elements such as the first connecting element 41, the second connecting element 42, and the third connecting element 43 to fix the stem 20 for reducing its shaking. In addition, the provision of the concave portion 12 can destroy the structure of the base portion 10 and reduce the stress concentration between the base portion 10 and the stem 20, thereby greatly improving the durability of the artificial shuttlecock 1.

Figure 7:
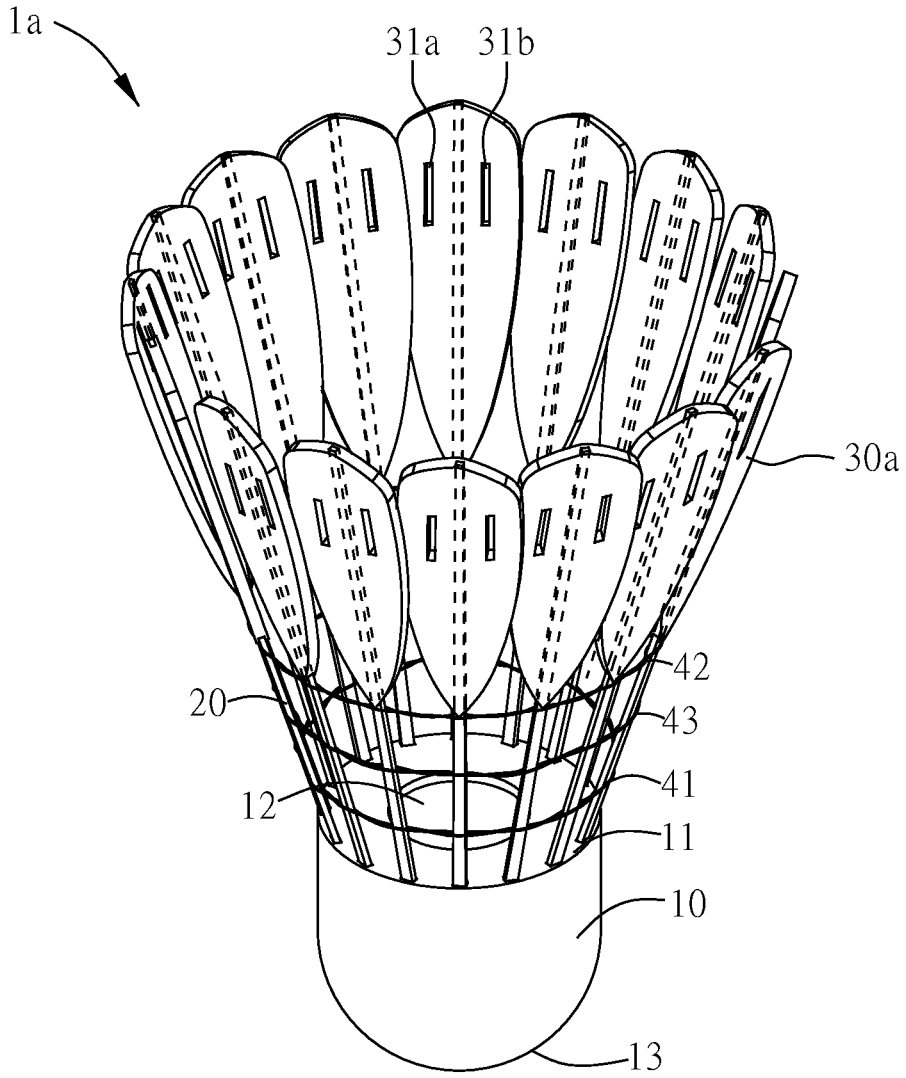
FIG. 7 is a schematic diagram of artificial shuttlecock of another embodiment of the present disclosure.

FIG. 7 is a schematic diagram of artificial shuttlecock 1*a* of another embodiment of the present disclosure. In this embodiment, the feather 30*a* comprises two holes 31*a*, 31*b*, and the holes 31*a*, 31*b* are respectively located on two opposite sides of the stem 20. The difference between the artificial shuttlecock 1*a* of this embodiment and the artificial shuttlecock 1 of the previous embodiment lies in the structure of the feather 30*a*, so the same designations as the previous embodiment are applied to other components. Preferably, the length of the holes 31*a*, 31*b* can be between 8.2 mm and 10.7 mm, and the width can be between 1 mm and 3 mm. In this embodiment, the length of the holes 31*a*, 31*b* takes 8.65 mm and width takes 1 mm as examples. In this embodiment, it is only necessary to provide holes 31*a* and 31*b* on both sides of the stem 20 to achieve different wind drag and improve the hitting feel.

In summary, according to the artificial shuttlecock of the present disclosure, at least three connecting elements of the first connecting element, the second connecting element, and the third connecting element are used to fix the stem 20 to reduce its shaking. In addition, the base portion has a concave portion, capable of destroying the structure of the base portion and reducing the stress concentration between the base portion and the stem, thereby avoiding the breakage of the stem. With the aforementioned two novel structural designs, the durability of the artificial shuttlecock is greatly improved.

Although the disclosure has been explained in relation to its preferred embodiment, many other possible modifications and variations can be made without departing from the spirit and scope of the disclosure as hereinafter claimed.

What is claimed is:

1. An artificial shuttlecock, comprising:

a base portion having a top surface and a concave portion, the concave portion being provided on the top surface;

a plurality of stems having a first end and a second end opposite to each other, and the first ends of the stems inserted onto the top surface of the base portion;

a plurality of feathers connected to one of the stems at close to the second end;

a first connecting element connected to the stems at close to the base portion;

a second connecting element connected to the stems at close to the feather; and at least one third connecting element connected to the stems and located between the first connecting element and the second connecting element.

2. The artificial shuttlecock defined in claim 1, wherein the adjacent two stems have a spacing range, and the first connecting element, the second connecting element, and the third connecting element are connected to the stem, so that the spacing range of the adjacent two stems is fixed.

3. The artificial shuttlecock defined in claim 1, wherein the distance between the first connecting element and the base portion is between 5 mm and 14.5 mm.

4. The artificial shuttlecock defined in claim 3, wherein the distance between the second connecting element and the feather is between 0.01 mm and 5 mm.

5. The artificial shuttlecock defined in claim 4, wherein the distance between the second connecting element and the base portion is between 17.5 mm and 29 mm.

6. The artificial shuttlecock defined in claim 1, wherein the first connecting element, the second connecting element, and the third connecting element are the same kind of members.

7. The artificial shuttlecock defined in claim 6 wherein the first connecting element, the second connecting element, and the third connecting element are respectively a wire wound around the stem.

8. The artificial shuttlecock defined in claim 1, wherein the first connecting element, the second connecting element, and the third connecting element are parallel to each other.

9. The artificial shuttlecock defined in claim 8, wherein the distances of the third connecting element with the first connecting element and with the second connecting element are substantially the same.

10. The artificial shuttlecock defined in claim 8, wherein the distances of the third connecting element with the first connecting element and with the second connecting element are between 5 mm and 17.5 mm.

11. The artificial shuttlecock defined in claim 1, wherein the base portion further comprises a convex surface located on the opposite side of the top surface, and the concave portion extends from the top surface to the convex surface.

12. The artificial shuttlecock defined in claim 11, wherein the concave portion is in a symmetrical shape on the top surface.

13. The artificial shuttlecock defined in claim 12, wherein the concave portion and the top surface are arranged in a manner of concentric circle.

14. The artificial shuttlecock defined in claim 13, wherein the volume of the concave portion accounts for 1% to 7% of the volume of the base portion.

15. The artificial shuttlecock defined in claim 14, wherein the weight of the base portion, after filling the concave portion with the same material as the base portion, is 0.06 g to 0.10 g more than the original weight of the base portion.

16. The artificial shuttlecock defined in claim 11, wherein the concave portion is symmetrical in shape with reference to a center C of the top surface.

17. The artificial shuttlecock defined in claim 16, wherein the concave portion is a circular-shape or a ring-shape.

18. The artificial shuttlecock defined in claim 1, wherein the material of the stem is a carbon fiber reinforced resin material.

19. The artificial shuttlecock defined in claim 1, wherein the feather comprises two holes, and the holes are respectively located on two opposite sides of the stem.

* * * * *